United States Patent [19]

Inoue

[11] Patent Number: 4,787,328

[45] Date of Patent: Nov. 29, 1988

[54] DRAWING AWAY DEVICE OF BILGE WATER FOR WATER JET PROPULSION

[75] Inventor: Seiji Inoue, Hamamatsu, Japan

[73] Assignee: Sanshin Kogyo Kabushiki Kaisha, Hamamatsu, Japan

[21] Appl. No.: 33,402

[22] Filed: Apr. 1, 1987

[30] Foreign Application Priority Data

Apr. 1, 1986 [JP] Japan ..... 61-72472

[51] Int. Cl.[4] ..... B63B 13/00

[52] U.S. Cl. ..... 114/183 R; 440/39; 114/270

[58] Field of Search ..... 114/183 R, 270; 440/38, 440/39, 89

[56] References Cited

U.S. PATENT DOCUMENTS

| | | | |
|---|---|---|---|
| 1,012,789 | 12/1911 | Aaron | 114/183 R |
| 1,023,843 | 4/1912 | Hall | 114/183 R |
| 1,769,136 | 7/1930 | Hepburn | 114/183 R |
| 2,627,242 | 2/1953 | Kiekhaefer | 440/89 X |
| 3,083,529 | 4/1963 | Hamilton | 440/38 X |
| 4,133,284 | 1/1979 | Holcroft | 440/38 X |

FOREIGN PATENT DOCUMENTS 3826220 9/1985 Japan .

*Primary Examiner*—Sherman D. Basinger
*Attorney, Agent, or Firm*—Ernest A. Beutler

[57] ABSTRACT

A number of embodiments for removing bilge water from a jet powered watercraft without obstructing the flow through the jet propulsion unit. In all of the embodiments, a portion of the water pressurized by the jet propulsion unit is diverted through a venturi section and the reduced pressure at the throat of the venturi section is used for drawing the bilge water. In many of the embodiments, the bilge water discharge opening is located so that bubbles will appear to the operator when the watercraft is in an idling mode for indicating to the operator that the bilge has been cleared of water. In one embodiment, the bilge water is discharge into the exhaust system of the engine for aiding in exhaust cooling.

11 Claims, 4 Drawing Sheets

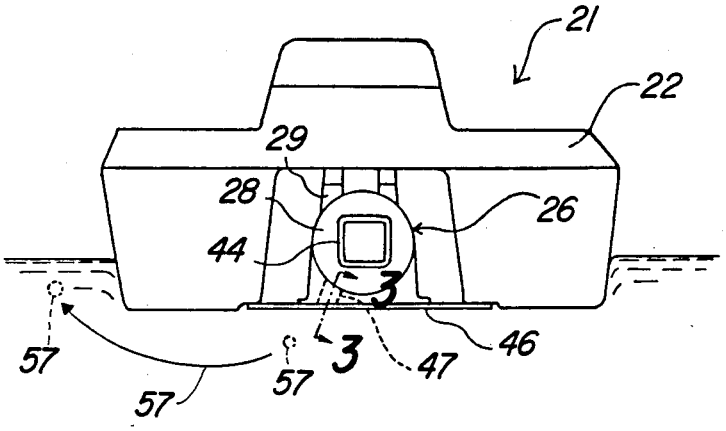
Fig-2
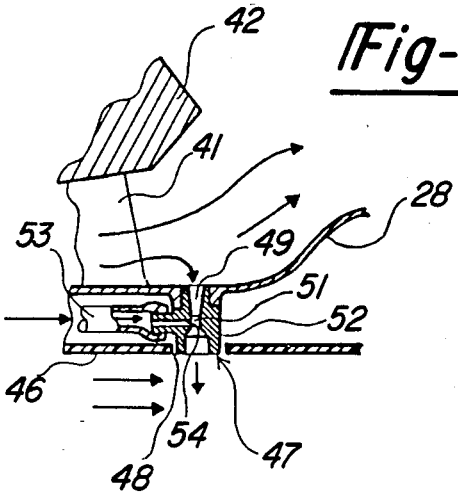
Fig-3
Fig-4
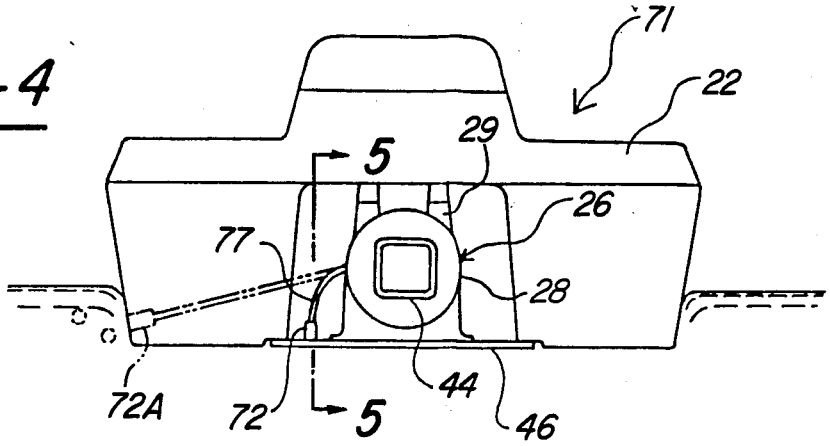

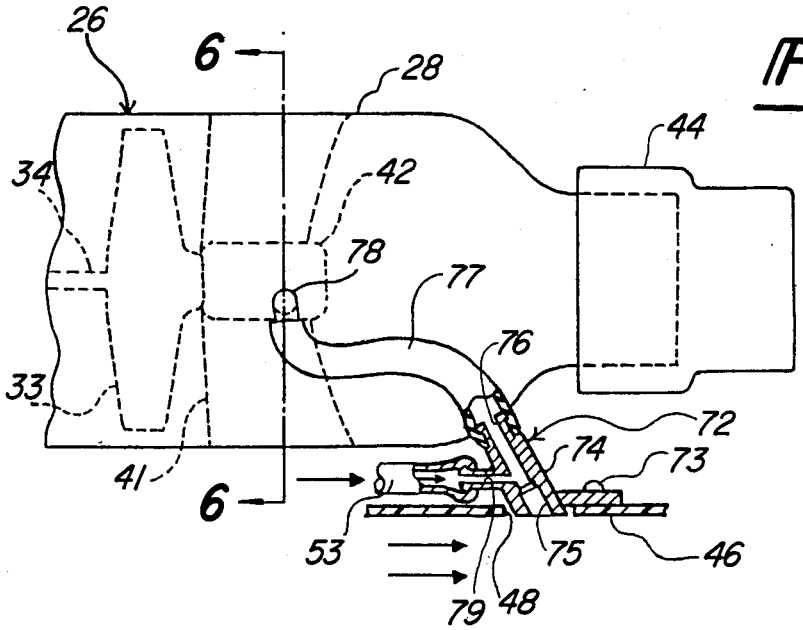
Fig-5
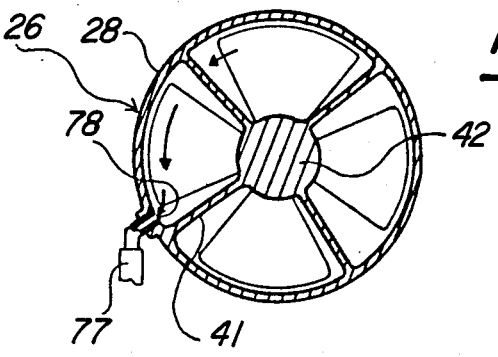
Fig-6
Fig-7
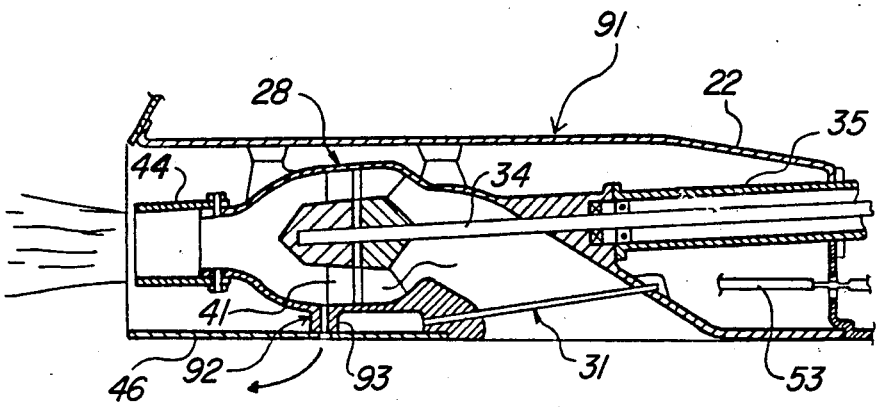

DRAWING AWAY DEVICE OF BILGE WATER FOR WATER JET PROPULSION

BACKGROUND OF THE INVENTION

This invention relates to a device for drawing bilge water from a water jet propelled watercraft and more particularly to an improved bilge water discharge system for a watercraft.

One very popular type of watercraft is powered by a jet propulsion unit. The jet propulsion unit includes an impeller that is driven by a powering engine and which draws water from the body of water in which the watercraft is operating in and discharges it so as to provide a propulsion force for the watercraft. With this type of watercraft, it has been a practice to employ the jet propulsion unit as a means for drawing bilge water from the hull of the watercraft. For example, as shown in U.S. Pat. No. 3,826,220, issued July 30, 1974 in the name of Clarence Jacobson, and in Japanese Patent No. Sho 52-14920, there are shown systems wherein the water jet propulsion unit is employed as an arrangement for generating a negative pressure to draw bilge water from the hull of the watercraft and discharge it back into the body of water through the jet propulsion unit. Although these systems are advantageous for removing the bilge water, they decrease the efficiency of the jet propulsion unit. For example, they require either the provision of a reduced diameter section in the jet propulsion unit so as to create a venturi effect or a nozzle that extends into the flow path through the jet propulsion unit. Either system causes the watercraft to lose efficiency in its jet pump. This is a result from the restriction to water flow through the jet propulsion unit caused by either the venturi section and/or the protruding nozzle.

It is, therefore, a principal object of this invention to provide an improved system for removing bilge water in a jet propelled vehicle which system does not reduce the efficiency of the jet propulsion unit.

It is a further object of this invention to provide an improved and simplified arrangement for removing bilge water in a jet propelled vehicle wherein the performance of the watercraft is not altered.

It is also desirable for the bilge water removing system to provide some way in which the watercraft operator can ascertain that all of the bilge water has been removed. For example, in conditions such as racing, it is important for the operator to know that the bilge is clear of water.

It is, therefore, a further object of this invention to provide a bilge water removing system for a watercraft in which the operator is given a visual indication that all bilge water has been removed.

It is another object of this invention to provide a bilge water removal system for a watercraft wherein the operation of the watercraft per se assists in the removal of the bilge water.

In watercraft powered by inboard mounted internal combustion engines, there is a difficulty in designing an effective system for discharge the exhaust gases to the atmosphere without causing difficulties due to the exhaust heat and its proximity to the hull.

It is a still further object of this invention to provide a bilge water removing system which is effective in further cooling the exhaust gases of the inboard mounted engine.

SUMMARY OF THE INVENTION

A first feature of this invention is adapted to be embodied in an arrangement for removing bilge water from a watercraft having a hull, an engine carried by the hull and a water jet propulsion unit driven by the engine for driving the watercraft. In accordance with this feature of the invention, means divert a portion of the water pressurized by the water jet back to the body of water in which the watercraft is operating through a conduit having a venturi section for creating an area of reduced static pressure. Means are provided for conveying bilge water from the hull to the venturi section for drawing bilge water from within the hull and discharging it back into the body of water in which the watercraft is operating.

Another feature of the invention is adapted to be embodied in an arrangement for removing bilge water from a watercraft having a hull and a powering internal combustion engine. In accordance with this feature of the invention, there is provided a conduit which wil convey water from the body of water in which the watercraft is operating back to the body of water through an outlet that is disposed in a surface of the hull that is adapted to experience a reduced pressure due to the movement of the hull through the water. The conduit is provided with a venturi section and means are incorporated for delivering bilge water from the hull to this venturi section under the influence of the reduced pressure created by the flow through the venturi section.

Yet another feature of this invention is adapted to be embodied in an arrangement for removing bilge waer from the hull of a watercraft having an internal combustion engine for powering the watercraft. The engine has an exhaust system for discharging exhaust gases back to the atmosphere from the engine. In accordance with this feature of the invention, means are provided for delivering bilge water from the hull to the exhaust system for discharge of bilge water from the hull and for cooling of the exhaust system.

BRIEF DESCRIPTION OF THE DRAWINGS

FIG. 2 is a rear elevational view of the watercrfat.

FIG. 3 is an enlarged cross-sectional view taken along the line 3—3 of FIG. 2.

FIG. 4 is a rear elevational view, in part similar to FIG. 2, showing other embodiments of the invention.

FIG. 5 is an enlarged cross-sectional view taken along the line 5—5 of FIG. 4.

FIG. 6 is a cross-sectional view taken along the line 6—6 of FIG. 5.

FIG. 7 is a partial cross-sectional view of a jet propulsion unit and watercraft constructed in accordance with yet another embodiment of the invention.

DETAILED DESCRIPTION OF THE PREFERRED EMBODIMENTS

Figure 1:
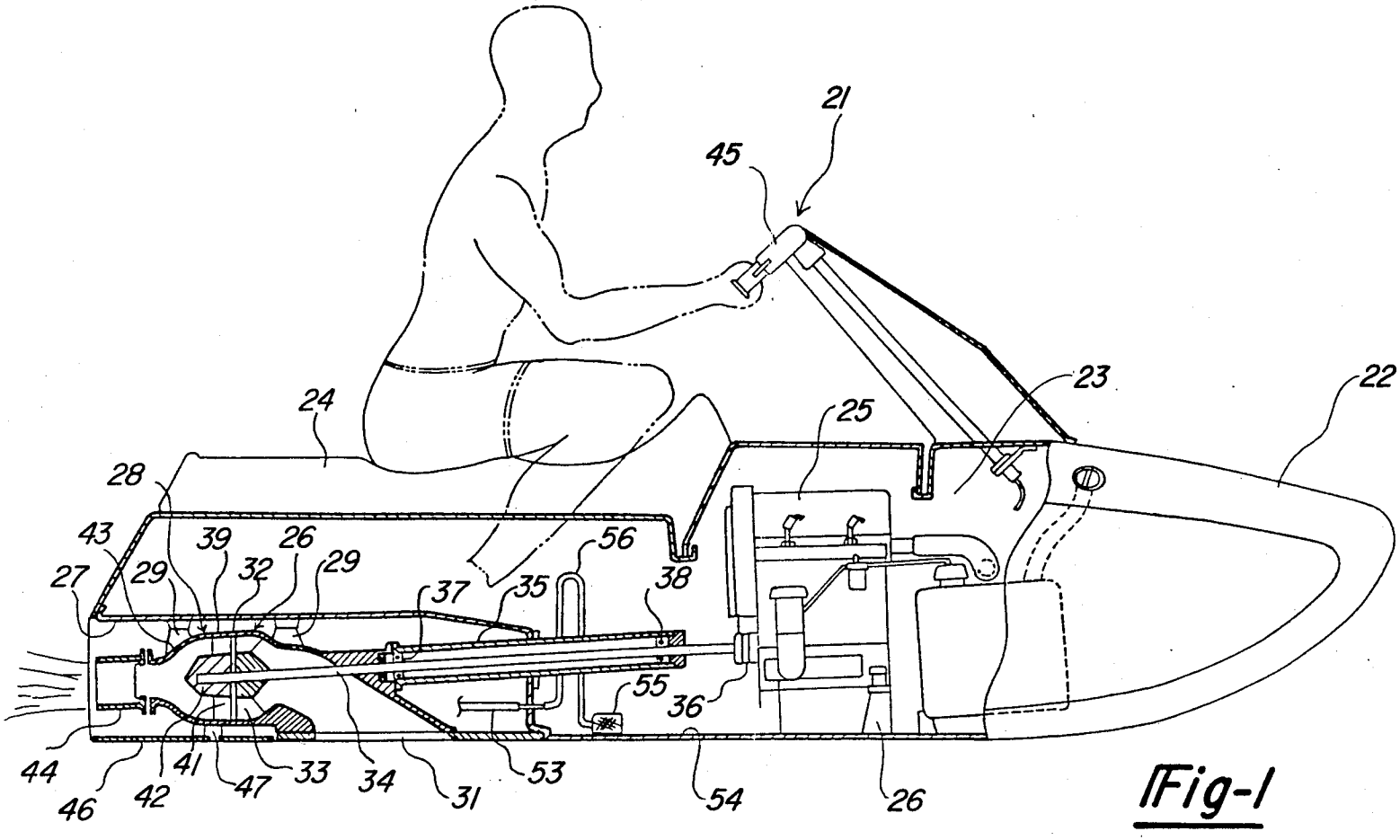
FIG. 1 is a side elevational view of a small jet propelled watercraft constructed in accordance with a first embodiment of the invention, with a portion broken away.

Referring first to the embodiment of FIGS. 1 through 3, a small watercraft constructed in accordance with this embodiment is identified generally by the reference numeral 21. The watercraft 21 is provided with a hull 22 which may be formed of a molded fiber glass reinforced plastic or the like. The hull 22 defines a forwardly positioned engine compartment 23 and a rearwardly positioned seat 24 that is designed to be operated primarily by a single rider seated in straddle fashion on the seat 24.

An internal combustion engine 25 of any known type is positioned within the engine compartment 23 and is supported by the hull 22 by engine mounts 26 in a known manner. The engine 25 drives a jet propulsion unit, indicated generally by the reference numeral 26 that is positioned in a tunnel or recess 27 formed centrally of the hull 22 and beneath the seat 24.

The jet propulsion unit 26 is comprised of an outer housing 28 that is suspended from the hull 22 by means of supports 29. The outer housing 28 includes a downwardly facing inlet portion 31 across which a suitable screen (not shown) extends for preventing the entry of foreign objects into the housing 28. Downstream of the inlet 31, the housing 28 is provided with a pumping chamber 32 in which an impeller 33 is supported in any known manner. The impeller 23 is affixed to a driving shaft 34 that extends forwardly into the engine compartment 25 through a support tube 35. The forward end of the drive shaft 34 is coupled to the output shaft of the engine 25 by means of a suitable coupling 36. It should be noted that bearings and seals 37 and 38 are supported at the opposite ends of the tube 35 so as to journal the drive shaft 34 and to seal the recess 27 from the engine compartment 23.

Downstream of the pumping section 32, the jet drive housing 28 is formed with a section 39 in which straightening vanes 41 are positioned. The straightening vanes are affixed to a central nacel 42 that forms a part of the housing 28 and which suitably journals the rear end of the drive shaft 34.

A discharge section 43 is formed in the pump housing 28 downstream of the nacel 42 and registers with a pivotally supported discharge nozzle 44 which is steered by the operator by means of a handlebar 45 in a known manner. Steering of the nozzle 44 accomplishes steering of the watercraft, as is well known in this art.

A blanking plate 46 is affixed to the lower side of the hull 22 and covers the remaining portion of the tunnel 27 so as to provide a smooth underwater surface.

The construction of the watercraft as thus far described may be considered to be conventional. For that reason, specific details of its construction which are not necessary to understnad the invention have not been illustrated nor will they be described. It is believed that those skilled in the art will readily understand how the invention can be practiced with any of a wide variety of types of watercraft, particularly those propelled by jet propulsion units.

In accordance with the invention, a bilge water removal and pumping device, indicated generally by the reference numeral 47, is provided. The device 47 is affixed to the area between the jet drive pump housing 28 and the blanking plate 46 and extends through an opening 40 formed in the blanking plate. As will be hereinafter noted, the opening 48 is positioned in an area where there will be a low pressure when the hull 22 is travelling through the body of water in which the watercraft 21 is operating so as to assist in bilge water explusion.

The pumping unit 47 includes an inlet portion 49 that is in registry with the chamber in which the straightening vanes are positioned so that a high pressure will exist at the opening 49. There is provided a venturi section 51 that communicates with the inlet opening 49 and which discharges through a discharge opening 52 formed at the lower end of the pumping device 47 and which communicates directly with the body of water in which the watercraft is operating. As a result, a small amount of water will be diverted through the pumping device 47 and specifically through its throat 51 so as to establish a low static pressure at this area.

A conduit 53 is connected to a bilge water inlet 54 that communicates with the venturi section 51 of the bilge water pumping device 47. The conduit 53 extends forwardly to a low point 54 in the hull 22 where bilge water is likely to accumulate. A filtering screen 55 is positioned over the open end of the conduit 53 so as to prevent the drawing of foreign matter other than bilge water into the conduit 53. There is also provided a trap section 56 with a small pin hole so that water cannot flow back into the bilge or hull 22 through the conduit 53 when the watercraft is not operating.

FIG. 3 shows the flow of water through the system as the watercraft is travelling through the water. It is be noted that the water pressure generated by the operation of the impeller 33 will cause a flow through the venturi throat 51. In addition, the movement of the hull 22 through the water will create a reduced pressure at the discharge opening 52 that will further act to implement the venturi action. This will cause any water to be drawn from the bilge area 54 through the strainer 55, trap 56 and conduit 53 for discharge into the throat 51 through the bilge water discharge 54. The bilge water will then return back to the body of water in which the watercraft 21 is operating. Therefore, the bilge water is removed without introducing any obstructions or restrictions in the jet pump unit per se.

In addition to the aforenoted advantage, it should be noted that when the watercraft is idling, there will still be sufficient flow through the device 49 to cause bilge water to be drawn. If there is no bilge water, there will be an air flow created through the conduit 53 and bubbles will appear as shown in FIG. 2 at 57 so that the operator of the watercraft can readily determine that the bilge is clear of water and the watercraft can be operated at maximum efficiency.

Figure 8:
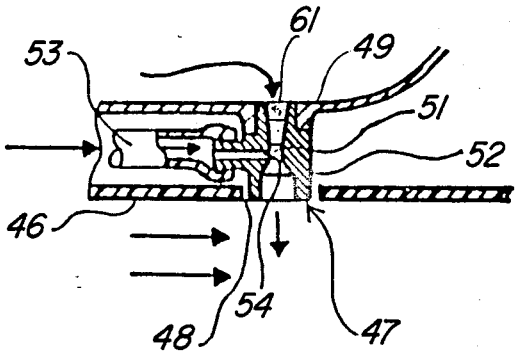
FIG. 8 is a cross-sectional view, in part similar to FIG. 3, showing yet another embodiment of the invention.

FIG. 8 shows another embodiment of the invention that is substantially the same as the embodiment of FIGS. 1 through 3. In this embodiment, however, a filter screen 61 is placed across the pumping device inlet opening 49 so as to preclude the intrusion of foreign materials that could plug the throat 51 or bilge water discharge 54. In all other respects, this embodiment is the same as the embodiment of FIGS. 1 through 3 and further discussion is not believed to be necessary for that reason.

Referring now to FIGS. 4 through 6, watercraft constructed in accordance with a third embodiment of the invention is identified generally by the reference numeral 71. The construction of the basic watercraft including the jet drive unit and powering internal combustion engine is the same as the embodiment of FIGS. 1 through 3 and, therefore, components which are the same as that previously described embodiment have been identified by the same reference numerals and will not be described again in detail except insofar as may be necessary to understand the construction and operation of this embodiment.

In this embodiment, a bilge water pumping device, indicated generally by the reference numeral 72, is fixed to the blanking plate 46 by means of a fastener 73. The pumping device 72 has a housing 74 that defines an enlarged diameter outlet 75 that communicates with the body of water in which the watercraft is operating through the opening 48 in the blanking plate.

The housing 74 defines an inlet 76 to which a flexible conduit 77 is attached. The conduit 77 extends to the pump housing 28 and specifically to an inlet opening 78 that is formed at a point in the housing 28 adjacent one of the straightening vanes 41 so as to receive high pressure water from this area. Since the conduit 77 is of a larger diameter than the inlet opening 76, there will be a venturi action occur due to the flow through this section for drawing water from the bilge through the conduit 53 as in the previously described embodiment.

The housing 74 is provided with a bilge water outlet 79 with which the conduit 53 cooperates so as to permit the removal of the bilge water. As with the previously described embodiment, when the bilge has been cleared of water, there will be bubbles appear that the operator can see and readily determine that the bilge has been cleared. Also, the area of the opening 75 is at a low pressure during watercraft operation so that this pressure difference will aid in the bilge ater removal.

In FIG. 4, there is shown an alternative mounting location 72A for the pumping device 72. This alternative location is in the side of the hull rather than in its underside. However, the opening is still positioned beneath the water level so that there will be a lower pressure area generated at the outlet for assisting in bilge water removal. By using the side of the hull outlet opening, the bubbles which occur when the bilge has been cleared will be more readily viewed by the operator.

Figure 9:
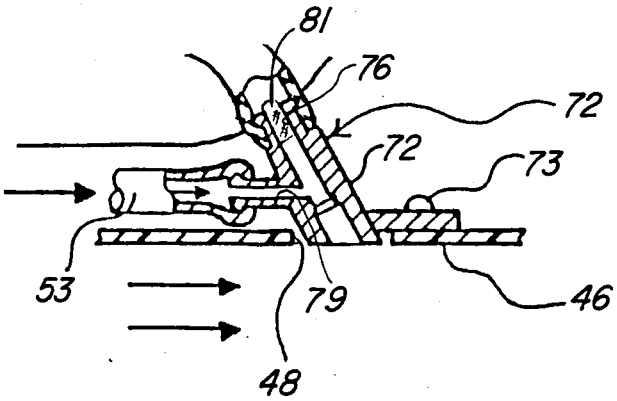
FIG. 9 is a cross-sectional view, in part similar to FIG. 5, showing a still further embodiment of the invention.

FIG. 9 shows another embodiment of the invention which is generally the same as the embodiment of FIGS. 4 through 6. However, in this embodiment, a screen 81 is provided across the inlet opening 76 so as to prevent the intrusion of foreign materials that could clog the venturi action or the bilge water discharge opening 79.

FIG. 7 is a partial view of a watercraft, indicated generally by the reference numeral 91, constructed in accordance with yet another embodiment of the invention. In this figure, only the jet drive unit is shown since it is only this portion of the construction which differs from the previously described embodiments. Again, the basic jet drive and watercraft construction is the same as the earlier described embodimemts and those components which are the same have been identified by the same reference numerals.

In this embodiment, a bilge water pumping device is indicated generally by the reference numeral 92 and is formed integrally with the pump housing 28. There is provided a passageway 93 that provides a venturi action for drawing water from the bilge through the conduit 53 and discharge back to the body of water in which the watercraft is operating. In all other regards, this embodiment is the same as those previously described and, for that reason, further description of this embodiment is not believed to be necessary.

Figure 10:
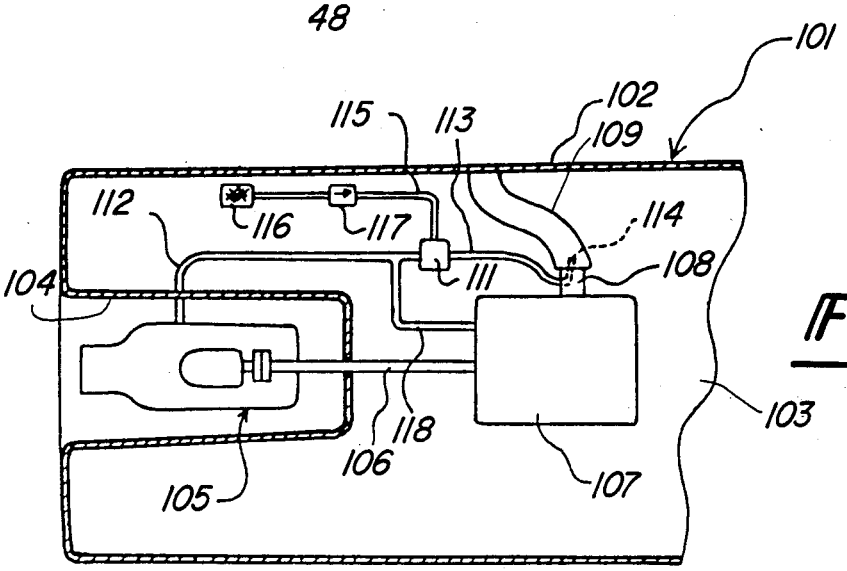
FIG. 10 is a partially schematic top plan view showing yet another embodiment of the invention.
Figure 11:
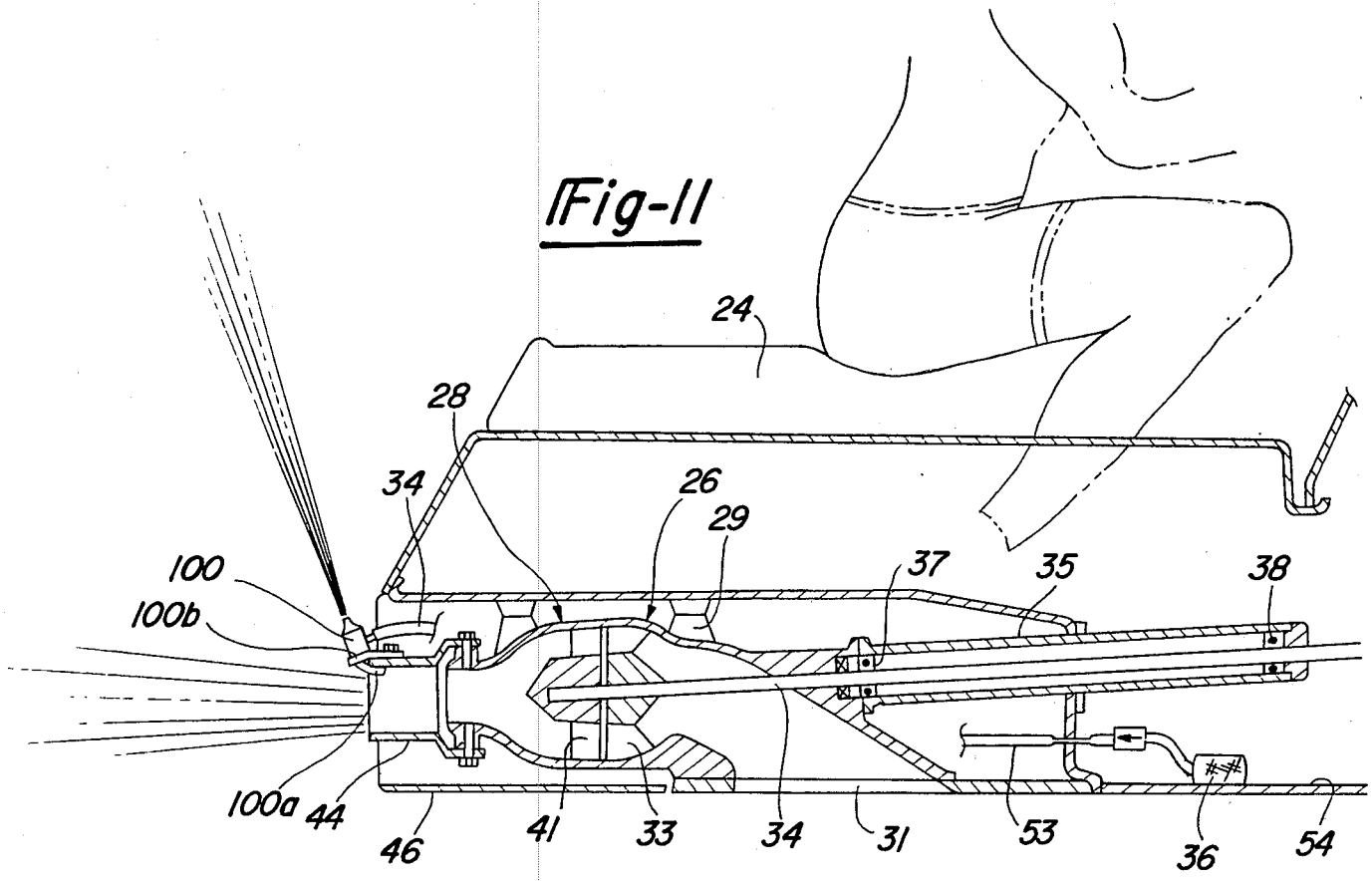

In the embodiments of the invention as thus far described, the pumping arrangement for removing the bilge water has been such that air bubbles will occur when the bilge has been cleared of water to give the operator a visual indication of that fact. FIG. 10 shows an embodiment of the invention where this result is not obtained but wherein the bilge water is used as a medium for assisting in the cooling of the exhaust gases of the engine.

A watercraft constructed in accordance with this embodiment is identified generally by the reference numeral 101. The watercraft 101 has a hull 102 that defines an engine compartment 103 and a tunnel 104 in which a jet drive unit, indicated generally by the reference numeral 105, is provided. The jet drive unit 105 is driven by a drive shaft 106 from an internal combustion engine 107 supported within the engine compartment 102 in a known manner.

The engine 107 has an exhaust system that includes an exhaust outlet port 108 that communicates with a flexible conduit 109 for discharging the exhaust gases to the atmosphere through an opening in the side of the hull 102.

In this embodiment, a bilge water pumping device 111 is provided which receives water diverted from the jet propulsion unit 105 at an appropriate location through a conduit 112. The source of water pressure from the jet drive unit 105 may be as in any of the previously described embodiments. In this embodiment, however, a discharge conduit 113 extends from downstream of the bilge water pumping device 111 to a discharge opening 114 facing in a downward direction in the flexible conduit 109. Hence, the water delivered through the bilge water pumping device 111 will be discharged into the exhaust system of the engine so as to cool the exhaust gases.

The bilge water removal system includes a conduit 115 having a screened opening 116 located at a low point in the hull 102. A check valve 117 rather than a trap of the previously described embodiments is provided in the conduit 115 so as to prevent reverse water flow through the conduit 115 when the watercraft is not operating. Hence, the bilge water will be ingested through the pumping device 111 and discharged into the exhaust system and specifically the conduit 109 to further aid in cooling. It should be noted that the flow of the exhaust gases tends to increase the pressure differential across the pumping device 111 and further aid its operation.

As a still further aid, there is provided a conduit 118 that extends from the cooling system of the engine back to the inlet side of the pumping device 11 so as to further aid in bilge water pumping.

It should be readily apparent from the foregoing description that a number of embodiments of the invention have been illustrated and described each of which is highly effective in removing bilge water without adversely affecting the performance of the jet drive unit per se. In addition, many of the embodiments provide a visual indication to the operator during idling when the bilge water has been removed. Furthermore, one of the embodiments assists in cooling the exhaust gases before they are discharge to the atmosphere by adding the bilge water to them. Various other changes and modifications from those embodiments disclosed may be made without departing from the spirit and scope of the invention, as defined by the appended claims.

I claim:

1. An arrangment for removing bilge water from a watercraft having a hull, an engine carried by said hull, a water jet propulsion unit driven by said engine for driving said watercraft, said water jet propulsion unit being operable through a speed range wherein water is moved through said propulsion unit at a slow speed for idling of said watercraft and a high speed for moving said watercraft in the water, means for diverting a portion of the water pressurized by said jet propulsion unit back to the body of water in which said watercraft is operating through a conduit having a venturi section for creating an area of reduced static pressure, and means for conveying bilge water to said venturi section for draining bilge water from within said hull and for discharging it into the body of water in which said watercraft is operating the opening of said conduit communicating with the water being positioned below the water line at least when said watercraft is idling so that an operator will see bubbles emanating from said opening during idle operation and when said bilge has been cleared of water.

2. An arrangement as set forth in claim 1 wherein the means for conveying bilge water to the venturi section includes a conduit extending to a low point in the hull and having an opening therein.

3. An arrangement as set forth in claim 1 further including strainer means for precluding the entry of foreign material into the venturi section.

4. An arrangement as set forth in claim 3 wherein the strainer means is at the inlet to the means for conveying bilge water to the venturi section.

5. An arrangement as set forth in claim 3 wherein the strainer means is at the water inlet to the venturi section.

6. An arrangement as set forth in claim 1 wherein the means for discharging the bilge water back into the body of water in which the watercraft is operating comprises an opening formed in an area of the hull where a low pressure exists during movement of the hull through the body of water for assisting in water removal.

7. An arrangement as set forth in claim 6 wherein the means for conveying bilge water to the venturi section includes a conduit extending to a low point in the hull and having an opening therein.

8. An arrangement as set forth in claim 6 further including strainer means for precluding the entry of foreign material into the venturi section.

9. An arrangement as set forth in claim 8 wherein the strainer means is at the inlet to the means for conveying bilge water to the venturi section.

10. An arrangement as set forth in claim 8 wherein the strainer means is at the water inlet to the venturi section.

11. An arrangement as set forth in claim 1 wherein the opening is in the side of the hull

* * * * *